US010400656B2

(12) United States Patent
Itoo et al.

(10) Patent No.: US 10,400,656 B2
(45) Date of Patent: Sep. 3, 2019

(54) COOLING FAN

(71) Applicant: KAWASAKI JUKOGYO KABUSHIKI KAISHA, Hyogo (JP)

(72) Inventors: Seiji Itoo, Akashi (JP); Shinichi Tanaka, Kakogawa (JP); Ayumi Hamada, Akashi (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 277 days.

(21) Appl. No.: 14/585,833

(22) Filed: Dec. 30, 2014

(65) Prior Publication Data

US 2016/0186643 A1 Jun. 30, 2016

(51) Int. Cl.

| | |
|---|---|
| ***F01P 1/06*** | (2006.01) |
| ***F01P 11/12*** | (2006.01) |
| ***F01P 1/00*** | (2006.01) |

(52) U.S. Cl.

CPC ..... *F01P 1/06* (2013.01); *F01P 11/12* (2013.01); *F01P 2001/005* (2013.01)

(58) Field of Classification Search

CPC .. F01P 1/06; F01P 2001/005; F01P 2003/001; F01P 3/20; F01P 5/02; F01P 7/026; F01P 7/16; B60H 1/00521; B61C 5/02; F04D 29/40; F04D 29/403; F04D 29/522; F04D 29/644; F04D 29/646; F04D 29/526; F04D 29/4226; B60K 11/06; F28F 2250/08

USPC ..... 123/41.57, 41.65; 415/196, 200, 201, 415/213.1, 220

See application file for complete search history.

(56) References Cited

U.S. PATENT DOCUMENTS

| | | | | |
|---|---|---|---|---|
| 6,595,178 | B2 * | 7/2003 | Araki | F02B 75/16 123/195 R |
| 2005/0217907 | A1 * | 10/2005 | Madson | F01P 5/06 180/68.1 |
| 2006/0081353 | A1 * | 4/2006 | Inniger | F04D 29/545 165/41 |
| 2006/0270503 | A1 * | 11/2006 | Suzuki | F16H 57/0489 474/144 |
| 2013/0087403 | A1 * | 4/2013 | Itoo | F16H 57/0416 180/339 |

* cited by examiner

*Primary Examiner* — Grant Moubry
*Assistant Examiner* — Ruben Picon-Feliciano
(74) *Attorney, Agent, or Firm* — Wenderoth, Lind & Ponack, L.L.P.

(57) ABSTRACT

A cooling fan for use in a utility vehicle, wherein the cooling fan is equipped with a fan cover for covering the upper half portion of the cooling fan and is accommodated inside an engine room that is configured so as to take in the outside air from the lower side and to be accessible from the upper side, and the fan cover is fixed to an engine case.

6 Claims, 5 Drawing Sheets

COOLING FAN

BACKGROUND OF THE INVENTION

1. Field of the Invention

The present invention relates to a cooling fan for use in a utility vehicle.

2. Description of the Related Art

Conventionally, in the case that a fan cover is installed on the cooling fan of the water-cooled diesel engine mounted on a utility vehicle, the fan cover is installed so as to cover the whole of the cooling fan.

SUMMARY OF THE INVENTION

Accordingly, an object of the present invention is to provide a cooling fan that is equipped with a rational fan cover capable of improving cooling performance while access to the area around the cooling fan is facilitated.

For the purpose of attaining the above-mentioned object, a cooling fan for use in a utility vehicle according to the present invention is characterized in that:

the cooling fan is equipped with a fan cover for covering the upper half portion of the cooling fan and is accommodated inside an engine room that is configured so as to take in the outside air from the lower side and to be accessible from the upper side, and that the fan cover is fixed to an engine case.

With the above-mentioned configuration, since the fan cover covers the upper half portion of the cooling fan, the fan cover prevents foreign matter from entering the cooling fan from the upper side, and the assembly of the fan cover from the upper side is facilitated, and, furthermore, in taking in the outside air from the lower side, the cooling performance of the cooling fan can be improved in comparison with the configuration in which the fan cover covers the whole of the cooling fan. Moreover, since the fixing positions of the fan cover are provided on the engine case, it is not necessary to newly provide fixing positions, whereby a rational installation structure can be obtained.

Furthermore, it is preferable that the cooling fan according to the present invention should have the following configurations:

(1) The fan cover is fixed to a crank case in which the engine is accommodated and a thermo-case in which a thermostat is accommodated.

(2) The fan cover has a semi-circular shape formed of an upper face having a curved face and a lower face having a flat face in a side view, and the flat face of the lower face is opposed to the opening located in the lower front face of the engine room and is inclined upward toward the front side.

(3) In the above-mentioned configuration (2), the curved face of the upper face has a plate shape and the side face formed of the upper face and the lower face has a mesh-like shape.

(4) The fan cover is extended so as to protrude from the engine so that the air from the cooling fan is blasted to the auxiliary apparatuses disposed in the vicinity of the engine.

(5) The thermostat is provided in the vicinity of the engine and the radiator for cooling the engine is disposed outside the engine room.

(6) Of the shafts rotated by the power of the crankshaft of the engine, the rotation shaft of the cooling fan is provided so as to be coaxial with the shaft positioned at the highest position.

With the above-mentioned configuration (1), since the fixing positions of the fan cover are provided on the crank case and the thermo-case, it is not necessary to newly provide fixing positions, whereby a rational installation structure can be obtained.

With the above-mentioned configuration (2), it is possible to provide the fan cover through which the cooling fan can efficiently take in the outside air from the opening of the engine room while the upper half portion of the cooling fan is covered.

The above-mentioned configuration (3) is a specific configuration of the fan cover. With this configuration, foreign matter is prevented from intruding from above the cooling fan, the assembly of the fan cover from the upper side is facilitated, and furthermore, the outside air is efficiently taken in from the front side of the cooling fan in its axial center direction and from the lower side thereof, and still further, exhaust gas can be discharged to the rear side of the cooling fan in its axial center direction.

With the above-mentioned configuration (4), the air from the cooling fan can be blasted to the auxiliary apparatuses of the engine, and the temperature of the auxiliary apparatuses can be lowered efficiently.

With the above-mentioned configuration (5), the cooling fan can be used to lower the temperature of the surface of the engine (including the auxiliary apparatuses for the engine) and the temperature of the engine room while the radiator is disposed in a chamber different from the engine room.

With the above-mentioned configuration (6), the cooling fan can be disposed at a position as high as possible inside the engine room while using the power of the crankshaft. As a result, muddy water and the like can be suppressed from being stirred upward by the rotation of the cooling fan.

In conclusion, the present invention can provide a cooling fan that is equipped with a rational fan cover capable of improving cooling performance while access to the area around the cooling fan is facilitated.

DETAILED DESCRIPTION OF THE INVENTION

[Overall Structure of Vehicle]

Figure 1:
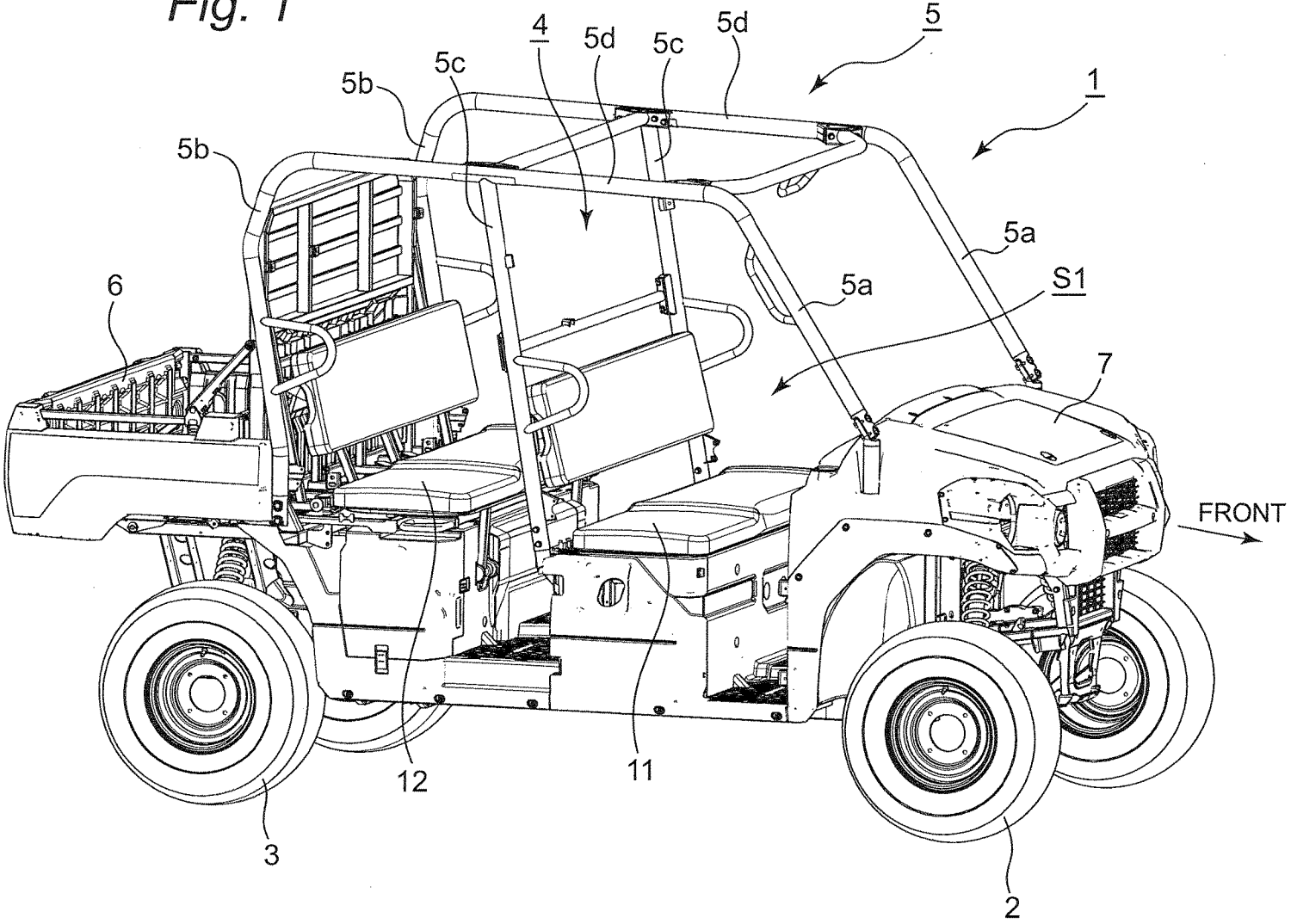
FIG. 1 is a perspective view showing a utility vehicle equipped with a cooling fan according to an embodiment of the present invention.
Figure 2:
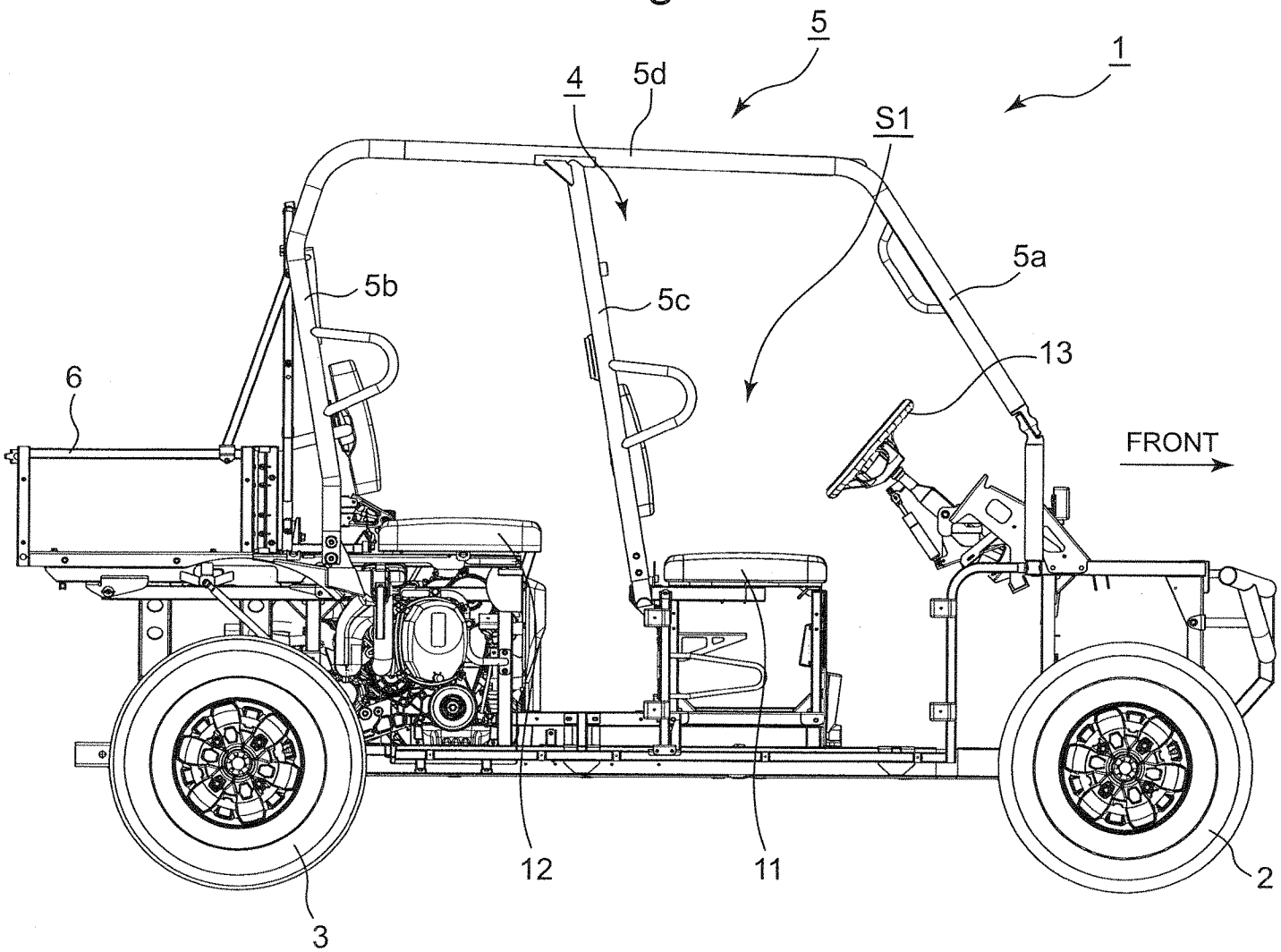
FIG. 2 is a right side view showing the utility vehicle shown in FIG. 1.

FIG. 1 is a perspective view showing a utility vehicle equipped with a cooling fan according to an embodiment of the present invention. The concept of directions for use in this embodiment is described so as to be matched with the concept of the directions as viewed from the driver of the utility vehicle. FIG. 2 is a right side view showing the utility vehicle shown in FIG. 1.

As shown in FIGS. 1 and 2, a utility vehicle 1 is equipped with a pair of left and right front wheels 2 at the front portion of the vehicle body, a pair of left and right rear wheels 3 at the rear portion of the vehicle body, and a boarding space (cabin) 4 between the front wheels 2 and the rear wheels 3. The boarding space 4 is enclosed with a ROPS 5. The ROPS 5 is an abbreviation for rollover protective structure, is part of the vehicle frame, and is equipped with a pair of left and right front vertical members 5*a*, a pair of left and right rear vertical members 5*b*, a pair of left and right intermediate vertical members 5*c* disposed between the front vertical members 5*a* and the rear vertical members 5*b*, and a plurality of upper end beam members 5*d* for connecting the upper end portions of the respective vertical members 5*a*, 5*b* and 5*c*. In addition, a cargo bed 6 is provided behind the boarding space 4, and a bonnet 7 is provided in front of the boarding space 4. A bench-type front seat 11 is installed in the front half portion of the boarding space 4, and a bench-type rear seat 12 is installed in the rear half portion of the boarding space 4. The left seat region S1 of the front seat 11 is the driver's seat, and operation portions, such as a steering wheel 13, are provided in front of the left seat region S1.

Figure 3:
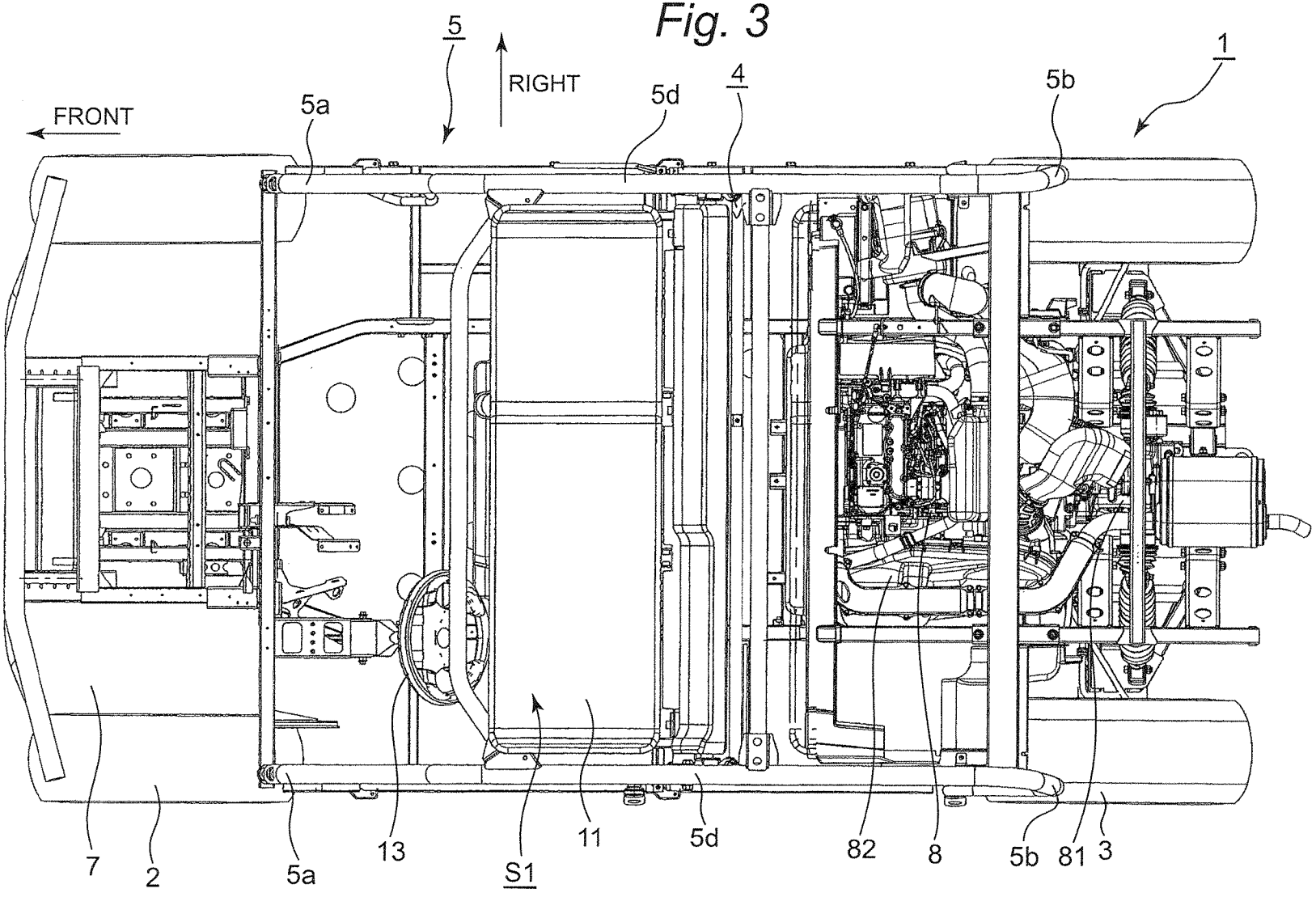
FIG. 3 is a top view showing the utility vehicle shown in FIG. 1.

FIG. 3 is a top view showing the utility vehicle shown in FIG. 1. FIG. 3 shows a state in which the rear seat 12 and the cargo bed 6 are removed. As shown in FIGS. 2 and 3, an engine 8 is disposed behind the rear seat 12, and a transmission 81 for converting the drive power generated from the engine 8 and for transmitting the drive power to the wheels is disposed behind the engine 8. The engine 8 and the transmission 81 are configured so as to be separate from each other, and the drive power of the engine 8 is transmitted to the transmission 81 by a belt converter 82 that is installed on the left side face of the engine 8 and the left side face of the transmission 81. The belt converter 82 is a V-belt type continuously variable transmission and performs automatic transmission depending on the rotation speed of the engine 8 and the increase/decrease of the load on the side of the wheels.

[Structure of Cooling Fan]

Figure 4:
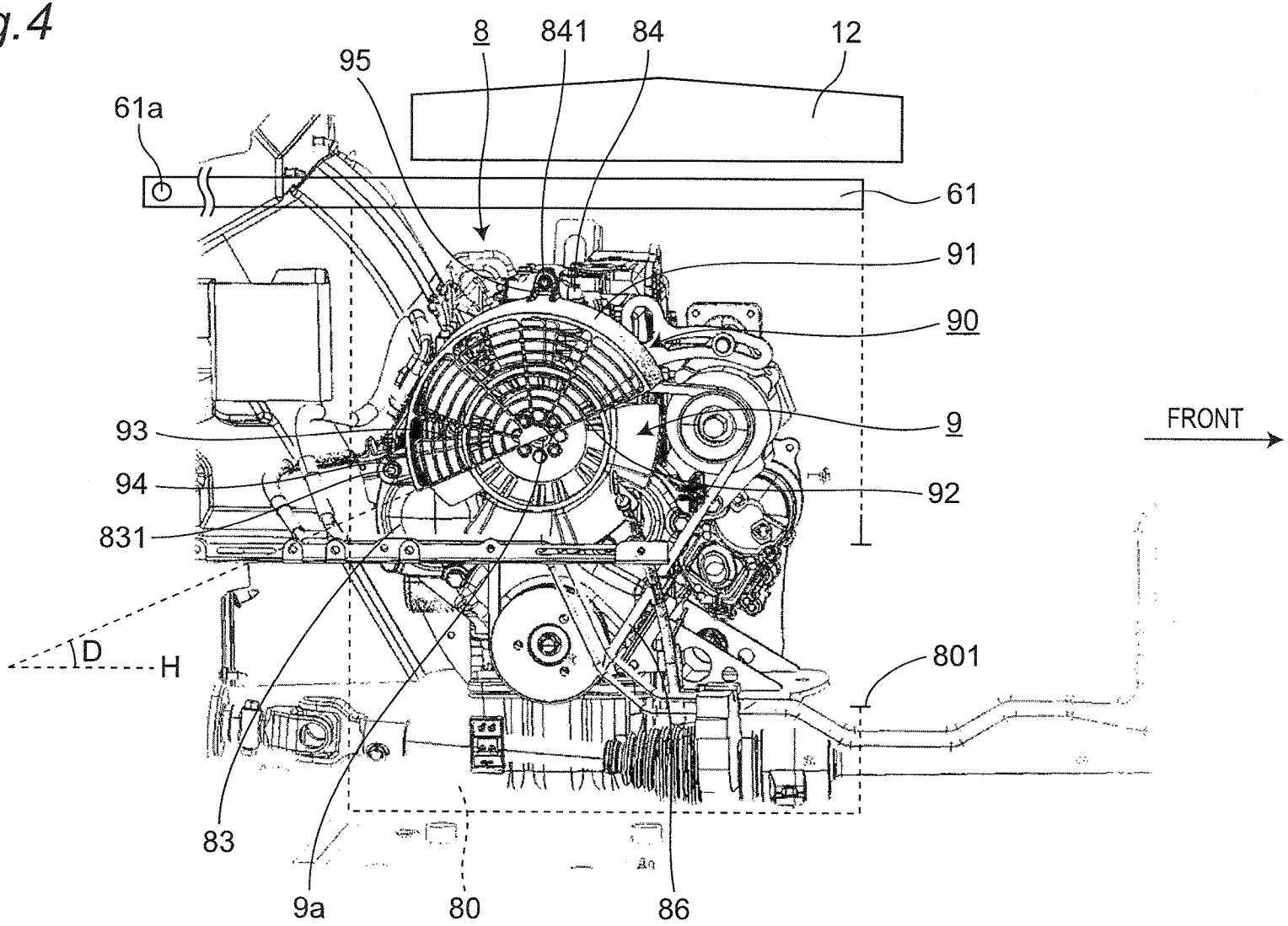
FIG. 4 is a side view showing the cooling fan.

FIG. 4 is a side view showing a cooling fan 9. As shown in FIG. 4, an engine room 80 for accommodating the engine 8 is formed below the rear seat 12, the engine room 80 is equipped with an opening 801 in its lower front face, and the bottom plate 61 of the cargo bed 6 is disposed on the upper face of the engine room 80. The opening 801 is formed between the floor board and the under guard of the utility vehicle. The bottom plate 61 is rotatable upward around a shaft 61*a*, and access to the engine room 80 is made possible by opening the bottom plate 61 upward. The engine 8 is a water-cooled diesel engine, and a radiator (not shown) that is used to cool the cooling water for cooling the engine 8 is disposed outside the engine room 80 and inside the bonnet 7. The radiator is cooled by the motor fan disposed inside the bonnet 7.

Figure 5:
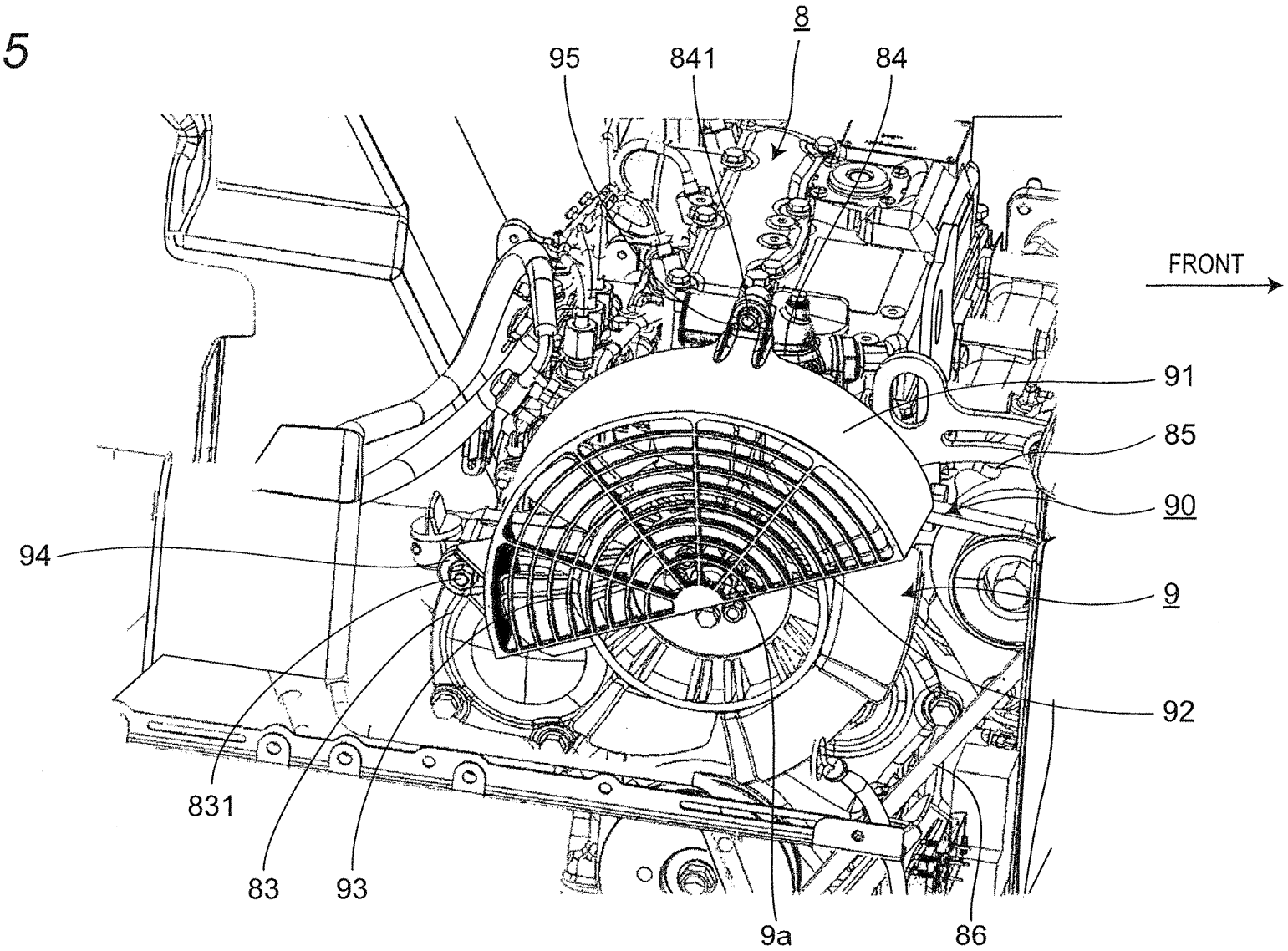
FIG. 5 is a perspective view showing the cooling fan.

FIG. 5 is a perspective view showing the cooling fan 9. As shown in FIGS. 4 and 5, the rotation shaft 9*a* of the cooling fan 9 is provided so as to be coaxial with the shaft of the water pump for circulating the cooling water for cooling the engine 8. Of the shafts rotated by the power of the crankshaft of the engine 8, the shaft of the water pump is placed at the highest position.

The cooling fan 9 is equipped with a fan cover 90 for covering the upper half portion of the cooling fan 9. The fan cover 90 has a semi-circular shape formed of an upper face 91 having a curved face and a lower face 92 having a flat face in a side view and is made of a metal, for example, iron. The upper face 91 of the fan cover 90 has a plate shape, and the side face 93 thereof that is formed of the upper face 91 and the lower face 92 has a mesh-like shape. The flat face of the lower face 92 is opposed to the opening 801 of the engine room 80 and is inclined upward toward the front side. The inclination angle D of the lower face 92 with respect to the horizontal face H is approximately 15 to 45 degrees depending on the position and size of the opening 801 and is preferably approximately 30 degrees. The fan cover 90 is not configured so as to cover the whole of the power transmission belt 86 of the engine 8.

The fan cover 90 is fixed at two points on a crank case 83 in which the engine 8 is accommodated and a thermo-case 84 in which a thermostat is accommodated. The crank case 83 is provided with a screw hole and a seat face, and the fan cover 90 is installed on the crank case 83 with a bolt 831. Furthermore, the thermo-case 84 is also provided with a screw hole and a seat face at its thermo-cap portion, and the fan cover 90 is installed on the thermo-case 84 with a bolt 841. The installation portion 94 of the fan cover 90 on the side of the crank case is provided in the vicinity of the rear end portion of the upper face 91, and the installation portion 95 of the fan cover 90 on the side of the thermo-case is not provided in the vicinity of the front end portion of the upper face 91, but is provided in the vicinity of the central portion thereof. In other words, the fan cover 90 is configured so as to extend to the front side with respect to the installation portion 95 on the side of the thermo-case.

As described above, the fan cover 90 extends to the front side with respect to the installation portion 95 on the side of the thermo-case, and its front end portion is positioned in front of the front end portion of the engine 8. In addition, auxiliary apparatuses 85, such as an alternator, to be affected by the heat from the exhaust manifold of the engine 8 are disposed in the vicinity of the front side of the engine 8. The fan cover 90 is extended so as to protrude forward from the engine 8 so that the air from the cooling fan 9 is blasted to the auxiliary apparatuses 85 disposed in the vicinity of the front side of the engine 8.

The cooling fan 9 having the above-mentioned configuration can deliver the following effects.

(1) Since the fan cover 90 covers the upper half portion of the cooling fan 9, the fan cover 90 prevents foreign matter from entering the cooling fan 9 from the upper side, and the assembly of the fan cover 90 from the upper side is facilitated, and, furthermore, in taking in the outside air from the lower side, the cooling performance of the cooling fan 9 can be improved in comparison with the configuration in which the fan cover 90 covers the whole of the cooling fan 9. Moreover, since the fan cover 90 does not cover the lower half portion of the cooling fan 9, muddy water and the like intruding from the lower side of the cooling fan 9 to the cooling fan 9 can be blown away by the rotation of the cooling fan 9, whereby accumulation (or adhesion) of muddy water and the like can be suppressed.

(2) Since the fixing positions of the fan cover 90 are located at the crank case 83 and the thermo-case 84, it is not necessary to newly provide fixing positions, whereby a rational installation structure can be obtained.

(3) Since the fan cover 90 has a semi-circular shape formed of the upper face 91 having a curved face and the lower face 92 having a flat face in a side view and the flat face of the lower face 92 is opposed to the opening 801 positioned at the lower front face of the engine room 80 and inclined upward toward the front side, it is possible to provide the fan cover 90 through which the cooling fan 9 can efficiently take in the outside air from the opening 801 of the engine room 80 while the upper half portion of the cooling fan 9 is covered.

(4) Since the curved face of the upper face 91 has a plate shape and the side face 93 formed of the upper face 91 and the lower face 92 has a mesh-like shape, foreign matter is prevented from intruding from above the cooling fan 9, the assembly of the fan cover from the upper side is facilitated, and furthermore, the outside air is efficiently taken in from the front side of the cooling fan in its axial center direction (the right side of the cooling fan 9) and from the lower side thereof, and still further, exhaust gas can be discharged to the rear side of the cooling fan in its axial center direction (the left side of the cooling fan 9).

(5) Since the fan cover 90 is extended so as to protrude forward from the engine 8 so that the air from the cooling fan 9 is blasted to the auxiliary apparatuses 85 disposed in the vicinity of the front side of the engine 8, the air from the cooling fan 9 can be blasted to the auxiliary apparatuses 85, and the temperature of the auxiliary apparatuses 85 can be lowered efficiently.

(6) Since the thermostat accommodated in the thermo-case 84 is provided in the vicinity of the engine 8 and the radiator for cooling the engine 8 is disposed outside the engine room 80, the cooling fan 9 can be used to lower the temperature of the surface of the engine 8 (including the auxiliary apparatuses for the engine) and the temperature of the engine room 80 while the radiator is disposed in a chamber different from the engine room 80.

(7) Of the shafts rotated by the power of the crankshaft of the engine 8, the rotation shaft 9*a* of the cooling fan 9 is provided so as to be coaxial with the rotation shaft of the cooling water pump serving as the shaft positioned at the highest position. Hence, the cooling fan 9 can be disposed at a position as high as possible inside the engine room 80 while using the power of the crankshaft. As a result, muddy water and the like can be suppressed from being stirred upward by the rotation of the cooling fan 9.

(8) Since the fan cover 90 is not configured so as to cover the whole of the power transmission belt 86 of the engine 8, the size of the fan cover 90 can be made small, whereby equipment associated with the cooling fan 9 can be made compact. As a result, it is possible to reduce the cost for the cooling fan 9.

With the above-mentioned embodiment, although the fan cover 90 is fixed to the crank case 83 and the thermo-case 84, the positions at which the fan cover 90 is fixed are not limited to the above-mentioned fixing positions, but the fan cover 90 may be fixed to an engine case directly or indirectly. The engine case herein includes a case for accommodating the engine, the auxiliary apparatuses for the engine, etc. The configuration in which the fan cover is fixed to the engine case indirectly means a configuration in which the fan cover is fixed to components or cases installed on the engine case. For example, the fan cover 90 may be fixed to the cylinder head cover of the engine 8.

With the above-mentioned embodiment, although the cooling fan 9 is positioned on one side of the engine 8 and the fan cover 90 is extended so as to protrude forward from the engine 8 so that the cooling fan 9 can cool the auxiliary apparatuses 85 disposed in the vicinity of the front side of the engine 8, the extension direction of the fan cover 90 is not limited to the above-mentioned direction, but the fan cover may extend so as to protrude from the engine toward the auxiliary apparatuses that are desired to be cooled by the cooling fan 9.

With the above-mentioned embodiment, although the upper face 91 of the fan cover 90 has a plate shape, the upper face 91 may have a mesh-like shape. However, the mesh is preferably fine to the extent that the upper face 91 can prevent foreign matter from intruding from above to the cooling fan 9.

With the above-mentioned embodiment, although the radiator that is used to cool the cooling water for cooling the engine 8 is disposed in the inside of the bonnet 7, the disposition position of the radiator is not limited to the inside of the bonnet 7 but the radiator may be disposed on the outside of the engine room 80. In other words, the cooling fan 9 is not used to cool the radiator.

The present invention can be modified and changed variously without departing from the spirit and scope of the present invention described in the appended claims.

What is claimed is:

1. A cooling fan in a utility vehicle having an engine room, the cooling fan in a utility vehicle comprising:

a cargo bed having a bottom plate disposed on an upper face of the engine room; and a fan cover for covering an upper half portion of the cooling fan, the fan cover being accommodated inside the engine room that is configured so as to take in outside air from a lower side and to be accessible from an upper side, wherein:

the engine room is equipped with an opening in a lower front face thereof, and the bottom plate of the cargo bed is rotatable upward;

the fan cover is fixed to an engine case;

the fan cover has a semi-circular shape as a whole formed of an upper face having a curved face and a lower face having a flat face in a side view; and the flat face of the lower face is opposed to the opening located in the lower front face of the engine room and is inclined upward toward a front side of the engine room, and an inclination angle of the lower face with respect to a horizontal face is approximately 15 to 45 degrees.

2. The cooling fan according to claim 1, wherein the fan cover is fixed to a crank case in which the engine is accommodated and a thermo-case in which a thermostat is accommodated.

3. The cooling fan according to claim 1, wherein the curved face of the upper face has a plate shape and a side face of the fan cover extends between the upper face and the lower face of the fan cover and has a mesh-like structure.

4. The cooling fan according to claim 1, wherein the fan cover is extended so as to protrude from the engine so that the air from the cooling fan is blasted to auxiliary apparatuses disposed in the vicinity of the engine.

5. The cooling fan according to claim 2, wherein the thermostat is provided in the vicinity of the engine and a radiator for cooling the engine is disposed outside the engine room.

6. The cooling fan according to claim 1, wherein a rotation shaft of the cooling fan is provided so as to be coaxial with a shaft positioned at the highest position of the shafts rotated by power of the crankshaft of the engine.

* * * * *